US008288689B1

(12) United States Patent
Adelman

(10) Patent No.: US 8,288,689 B1
(45) Date of Patent: Oct. 16, 2012

(54) RADIANT HEATING AND COOLING PANEL

(76) Inventor: Dean W. Adelman, Corcoran, MN (US)

( * ) Notice: Subject to any disclaimer, the term of this patent is extended or adjusted under 35 U.S.C. 154(b) by 638 days.

(21) Appl. No.: 12/552,423

(22) Filed: Sep. 2, 2009

Related U.S. Application Data

(60) Provisional application No. 61/093,611, filed on Sep. 2, 2008.

(51) Int. Cl.
*H05B 3/00* (2006.01)

(52) U.S. Cl. ..... 219/213; 219/200; 219/208; 219/209; 219/240; 219/241; 219/254; 219/264; 219/399; 219/409; 219/436

(58) Field of Classification Search ..... 219/213, 219/200, 208, 209, 240, 241, 254, 264, 399, 219/409, 436
See application file for complete search history.

(56) References Cited

U.S. PATENT DOCUMENTS

| | | | | |
|---|---|---|---|---|
| 4,759,402 | A | 7/1988 | Osojnak | |
| 5,029,231 | A | 7/1991 | Carr et al. | |
| 5,078,203 | A | 1/1992 | Shiroki | |
| 5,743,330 | A | 4/1998 | Bilotta et al. | |
| 5,931,381 | A | 8/1999 | Fiedrich | |
| 5,957,378 | A | 9/1999 | Fiedrich | |
| 6,094,878 | A | 8/2000 | Schluter | |
| 6,182,903 | B1 | 2/2001 | Fiedrich | |
| 6,188,839 | B1 | 2/2001 | Pennella | |
| 6,220,523 | B1 | 4/2001 | Fiedrich | |
| 6,270,016 | B1 * | 8/2001 | Fiedrich | 237/69 |
| 6,330,980 | B1 | 12/2001 | Fiedrich | |
| 6,533,185 | B1 | 3/2003 | Muir | |
| 6,926,077 | B2 | 8/2005 | Kuga et al. | |
| 7,013,609 | B2 | 3/2006 | Hydock | |
| D541,396 | S | 4/2007 | Fawcett et al. | |
| 2004/0016740 | A1 * | 1/2004 | McDonald | 219/213 |
| 2008/0017725 | A1 | 1/2008 | Backman, Jr. | |

OTHER PUBLICATIONS

"Service, der sich sehen lasst." Schutz Energy System,
"'R50' revolutionises renovation", Press Release, Schutz Energy Systems Nov. 2, 2009.
"Creatherm Launches New Radiant Floor Panel Product" Press Release, Creatherm, Aug. 2007.
Scholten, John A.; "Strength of Wood Joints Made with Nails, Staples, or Screws"; Forest Products Laboratory, Forest Service U.S. Department of Agriculture.
"Creatherm Radiant Floor Panels", Creatherm.
"Denkbar einfach-renovierem mit Schutz" Schutz Energy Systems.

* cited by examiner

*Primary Examiner* — Marc Armand
(74) *Attorney, Agent, or Firm* — Haugen Law Firm PLLP

(57) ABSTRACT

A panel for radiant heating and cooling includes a moisture impermeable shell with protrusions extended from a base. Channels between adjacent protrusions frictionally retain a thermal control component such as flexible tubing or an electrical heating element. The protrusions define chambers open at the bottom of the shell. An anchor in each chamber is secured to the top wall and extends downwardly beyond the base. A thermally conductive film is applied to the top surface of the shell. An insulative layer extends downwardly from inside the shell and beyond the base, surrounding the anchors while leaving bottom surfaces of the anchors exposed. The anchors are secured to a floor or substrate by an adhesive to integrally mount the panel. The anchors can receive and frictionally retain axially driven fasteners such as nails and staples, facilitating the attachment of a flooring overlayer integrally with respect to the substrate through the panel.

25 Claims, 5 Drawing Sheets

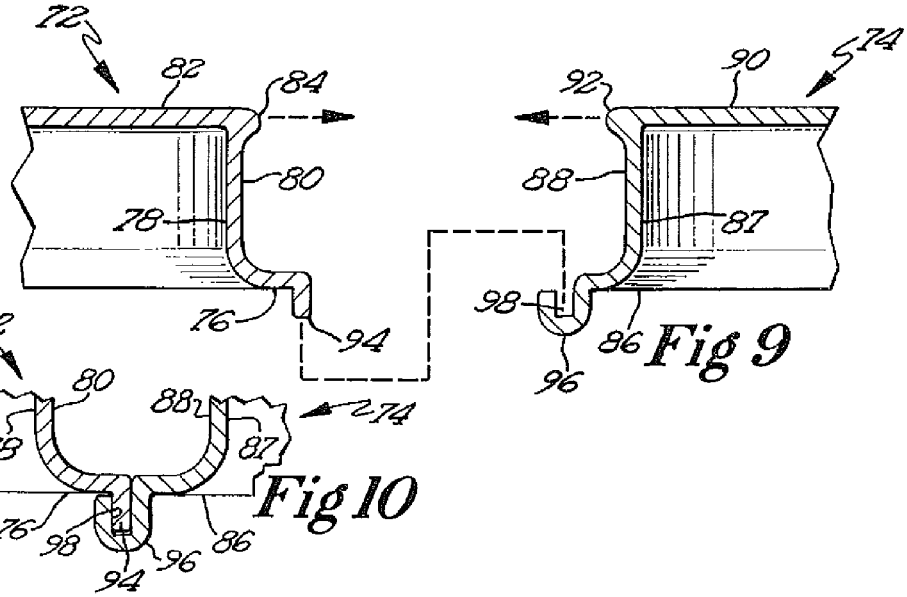
Fig 9
Fig 10
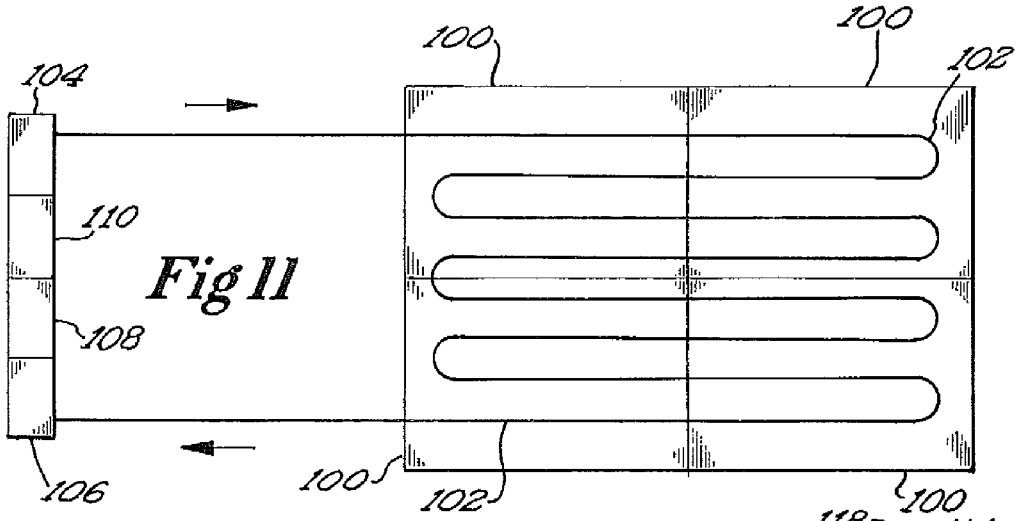
Fig 11
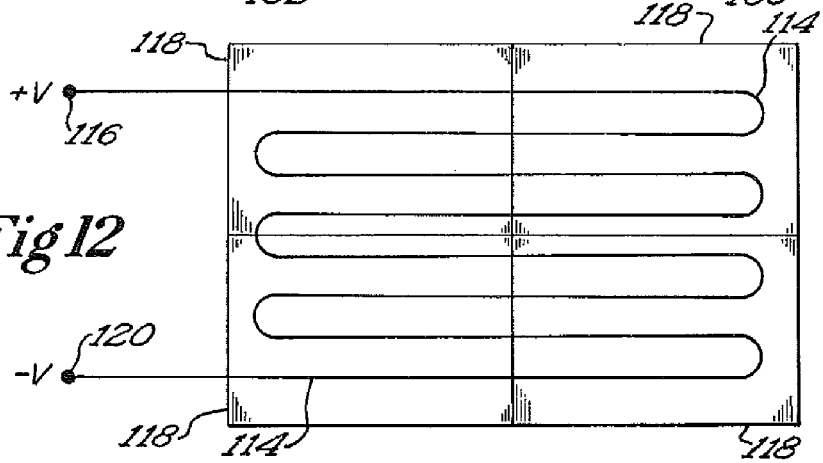
Fig 12

RADIANT HEATING AND COOLING PANEL

This application claims the benefit of priority based on Provisional Application No. 61/093,611 entitled "Radiant Heating and Cooling Panel," filed Sep. 2, 2008.

BACKGROUND OF THE INVENTION

The present invention relates to radiant heating and cooling systems for residential and commercial applications, and more particularly to panels and other modular units designed to facilitate the installation of these systems.

Radiant heating and cooling systems have become increasingly popular, not only for their capacity to deliver more comfortable and consistent heating and cooling, but also due to system improvements that have yielded up to forty percent more efficiency as compared to forced air systems. Nonetheless, several difficulties associated with the installation and use of these systems prevent what otherwise might be more widespread usage.

For example, most systems today are custom designed, with drawings prepared to reflect exacting measurements and requiring assembly of components by skilled individuals to meet plan specifications. Changes after installation begins, whether based on an impulse or required by an incorrect measurement or change in circumstances, are extremely difficult.

Another problem is the lack of sufficiently even heating and cooling, characterized for example by "hot spots" or "cold spots" on the floor of a floor-installed system. Frequently this is due to a somewhat fragmented nature of the installed system, in terms of breaks between strips or other areas of heat conductive material. In some floor mounted systems, heat conductive material is installed along the bottom of system panels. This has the unfortunate effect of drawing heat in a direction opposite to that where it is most needed.

Where a system is installed over a preexisting concrete floor, typically a moisture barrier is laid first, followed by an insulative layer, in turn followed by an underlayment or subfloor of wood. These components undesirably increase the height of the floor, frequently requiring the trimming of doors and molding.

To the extent that current systems provide panels, these panels tend to be heavy, due to the use of wood as the main panel component. The heavier panels are more expensive to ship, and more difficult to handle at the job site. Conversely, flooring panels composed largely of expanded foam insulation typically require a concrete over-pour to provide structural support and anchor a subsequent flooring layer. Further, the panels are largely designed for specific applications, e.g. new construction versus preexisting construction, heating versus cooling, hydronic heat versus electrical element heat, and self-supporting versus concrete over-pour.

Several systems have been proposed to counteract these difficulties. For example, U.S. Patent Application Publication Number 2008/0017725 (Backman, Jr.) discloses a panel that incorporates weight bearing support knobs with screw guide holes. The panel further incorporates cradles between pairs of adjacent support knobs to contain hydronic tubing. A layer of heat diffusing material can be attached to the support knobs with screws. The screws can extend through the knobs and into a sub-floor if desired.

U.S. Pat. No. 6,533,185 (Muir) is drawn to a hydronic radiant heating system in which a nonstructural board has a recess to receive hydronic tubing. A metal coating is applied to a top surface of the board by spraying, by plating, or as a foil.

In U.S. Pat. No. 5,931,381 (Fiedrich), a radiant heating panel includes a radiation plate formed of metal secured to a pair of holding boards. Between the holding boards, the plate is curved to provide a channel or slot designed to snugly receive the tubing. An insulative reinforcing mat can be installed to the holding boards on the side opposite to that of the radiation plate.

In a panel design available from Createc Corporation of Indianapolis, Ind., a solid panel formed of expanded polystyrene foam incorporates a series of knobs that extend upwardly from a panel base. The tubing is gripped between pairs of the knobs. This is a floor installed system, designed for concrete over-pouring.

Although the forgoing designs may be useful in certain applications, none of them effectively addresses all of the difficulties noted above. Therefore, the present invention has several aspects, each directed to one or more of the following objects:

- to provide a radiant heating and cooling panel incorporating an anchoring layer adapted for surface bonding to a substrate and further adapted to frictionally retain fasteners driven into the panel through an outer layer overlying the panel, to secure the cover layer integrally with respect to the substrate;
- to provide a radiant temperature control system in which a single, low profile subflooring layer incorporates a moisture impermeable shell shaped to retain an elongate flexible thermal control component, a thermally conductive film, a thermally insulative layer, and weight bearing structural members adapted to frictionally retain fasteners to secure a flooring layer overlying the subflooring layer;
- to provide a radiant heating panel shaped to retain an elongate flexible heating component, an insulative layer to minimize heat transfer from the heating component toward a substrate to which the panel is mounted, and a thermally conductive layer to facilitate heat transfer from the heating component away from the substrate; and
- to provide a process for installing radiant heating and cooling systems incorporating weight bearing and anchoring capability in less time, at reduced cost, and without the need for highly skilled labor.

SUMMARY OF THE INVENTION

To achieve these and other objects, there is provided a temperature control flooring system. The flooring system includes a moisture impermeable layer comprising a base and a plurality of projections extended upwardly from the base. Each of the projections comprises a substantially planar top wall and a peripheral wall between the top wall and the base. The top wall and peripheral wall cooperate to define an internal chamber open at the bottom. Adjacent projections are spaced apart from one another to define channels therebetween to receive a flexible elongate thermal control component. The projections are disposed in an array selected to enable and facilitate placement of the thermal control component in a path along the base disposed between different pairs of the projections. The system further includes an anchoring layer comprising a plurality of anchoring members individually associated with the projections. Each anchoring member occupies its associated chamber, attached to the associated top wall and extended downwardly to a location below the base. The anchoring layer further comprises a lower surface adapted for attachment to a substrate to integrally mount the moisture impermeable layer with respect to the substrate and structurally support the moisture impermeable layer. Each of the anchoring members is capable of exerting lateral forces to frictionally secure axially driven fasteners against axial withdrawal, thereby to facilitate use of such fasteners to mount a flooring layer in overlying relation to the moisture impermeable layer by advancing the fasteners through the flooring layer and moisture impermeable layer into the anchoring members.

In one preferred version of the flooring system, the anchoring layer consists essentially of the anchoring members, with each anchoring member having a bottom surface adhered to the substrate. In another preferred version, the anchoring layer further comprises a weight bearing layer adapted for bonding to the substrate. The weight bearing layer is integral with the anchoring members and disposed adjacent their bottom surfaces.

In either event, the anchoring members are capable of frictionally retaining nails, staples and similar fasteners normally installed by axial driving. In general, the anchoring members are formed of a material capable of yielding laterally to accommodate an axially driven nail or staple, resisting the tendency to crack or split while applying lateral compressive forces to the fastener sufficient to prevent axial withdrawal without the aid of a claw, bar or other extraction tool. The best known material of this character is wood. Composites of wood and plastic (sometimes known as engineered wood) also have this quality. Certain fiber-reinforced polymers also may be suitable.

Because of their fastener-retaining capability, the anchoring members when adhered to a substrate facilitate a rapid and reliable attachment of a flooring or subflooring cover layer over the moisture impermeable layer, simply by driving nails or other suitable fasteners through the cover layer and moisture permeable layer into the anchoring members. Thus, the cover layer is reliably secured and structurally supported without a concrete over-pour.

This is in contrast to conventional flooring systems with preformed weight bearing support knobs as in the aforementioned Backman application, or that use a layer of expanded polystyrene foam or other foam insulation beneath the moisture impermeable layer. In the former, the cover layer must be provided with openings that align with the openings preformed in the support knobs to receive screws. In the latter, the expanded foam lacks the fastener-retaining capability. Accordingly, these conventional approaches typically involve a concrete over-pour to provide structural support, a suitable base for mounting a cover layer, or both.

Another aspect of the present invention is a radiant heating and cooling panel. The panel comprises a structurally self supporting and moisture impermeable shell including a base and a plurality of projections. Each projection has a peripheral wall extending away from the base in an outward direction and a substantially planar outer wall joined to an outer end region of the peripheral wall. The outer wall cooperates with the peripheral wall to define an internal chamber of the projection open along an inward side of the shell. The projections are disposed in an arrangement to receive a flexible elongate thermal control component in a path and situated between different pairs of the projections. The projections of each adjacent pair are spaced apart from one another by a predetermined distance to accommodate placement of the thermal control component between the projections. A plurality of anchoring members are individually associated with the projections. Each anchoring member occupies the chamber of its associated projection, is attached to the associated outer wall and extends inwardly to locate an inner end region thereof inwardly of the base. An anchoring component is adapted to integrally attach the anchoring members to a substrate having a substantially planar substrate surface to secure the moisture impermeable shell integrally with respect to the substrate. The outer walls of the projections extend substantially along an outer plane parallel to the plane of the substrate surface when the anchoring members are so attached. Each of the anchoring members at least along an outer region thereof is capable of exerting lateral forces to frictionally secure axially driven fasteners against axial withdrawal, to facilitate use of such fasteners to mount an outer layer in overlying relation to the moisture impermeable shell by advancing the fasteners through the outer layer and shell into the anchoring members.

In one version of the panel, the projections are arranged in straight rows and columns. Each projection has a circular profile in planes parallel to the outer plane and extending through the peripheral wall. In this arrangement, the projection diameter establishes a minimum spacing between adjacent and parallel lengths of the tubing or other thermal control component, as well as a minimum radius of curvature along the tubing between adjacent linear segments. In other versions, the projections can be arranged in staggered columns and rows, and may have noncircular profiles, e.g. polygonal profiles or elongated profiles with semicircular end regions.

Preferred versions of the panel include a thermally conductive layer overlying and contiguous with an outside surface of the shell. In flooring panels, this promotes an upward transfer of heat toward and away from the tube or other thermal control component, and further promotes heat transfer into and away from regions between adjacent lengths of the tubing. In this manner, hot spots and cold spots are minimized or eliminated.

Other versions, particularly for heating systems, include a thermally insulative layer overlying and contiguous with an inside surface of the shell and extending inwardly beyond the base. This layer minimizes any transfer of heat from the tube or other thermal control component toward the substrate, thus to reduce waste heat and increase efficiently.

Another aspect of the invention is a process for installing a thermal control system, including the following steps:

a. providing a panel including a moisture impermeable shell with a base and a plurality of projections extending away from the base in an outward direction to form internal chambers open at the base, and an anchoring layer comprising a plurality of anchoring members individually associated with the projections, each anchoring member occupying its associated chamber with an outer end of the anchoring member integrally attached to an outer wall of the associated projection and extending inwardly to an inner end region disposed inwardly of the base;

b. mounting the panel to a substrate having a substrate surface using an adhesive between the substrate surface and an inner end surface of the anchoring layer to integrally secure the anchoring layer to the substrate;

c. after mounting the panel, positioning a flexible elongate thermal control component against the base in a path and disposed between adjacent pairs of the projections;

d. with the thermal control component so positioned, placing an outer layer against the outer walls of the projections to capture the thermal control component between the outer layer and the shell; and e. with the outer layer so placed, advancing a plurality of elongate fasteners axially through the outer layer and shell into the anchoring members to integrally secure the outer layer to the substrate via the panel.

Preferably the panel is mounted to the substrate by applying an adhesive to the inner end regions of the anchoring members. With the panel in place, the thermal control component is positioned by retaining the component frictionally between adjacent pairs of the projections. The preferred fasteners are nails, used to secure the outer layer by driving them through the outer layer and shell into the anchoring members.

A complete installation entails mounting an array of the panels side-by-side in columns and rows. Rapid installation is facilitated when the panels incorporate a thermally conductive film over an outside surface of the shell, a thermally insulative layer extending inwardly from an inside surface of the shell, and a pressure sensitive adhesive applied to inside surfaces of the anchoring members. The weight bearing, anchoring, insulative, heat transferring and adhesive functions are built into the panel, eliminating the need for added materials and labor to provide any of these functions.

Thus in accordance with the present invention, a panel in radiant heating and cooling systems incorporates support structure and anchoring structure, provides for ease for handling and installation without requiring highly skilled labor, is lightweight, low profile, thermally conductive where necessary to ensure even heating and cooling, and thermally insulative where necessary to minimize wasteful conduction of heat into a sub-floor or wall. The panels are not tied to any particular environment or type of radiant heating, and are suitable for new construction as well as remodeling.

IN THE DRAWINGS

For a further understanding of the forgoing and other features and advantages, reference is made to the following detailed description and to the drawings, in which.

Figure 6:
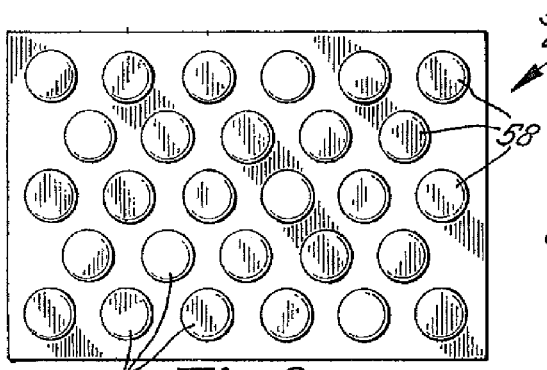
Figure 7:
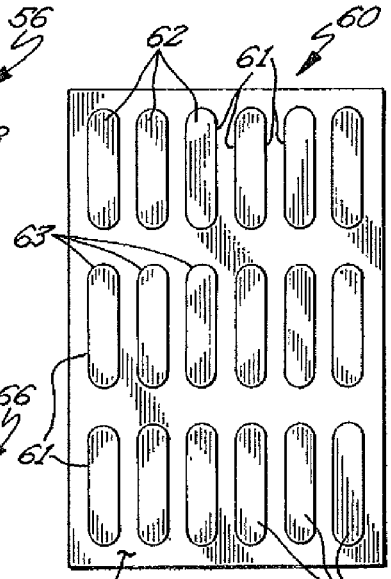
Figure 8:
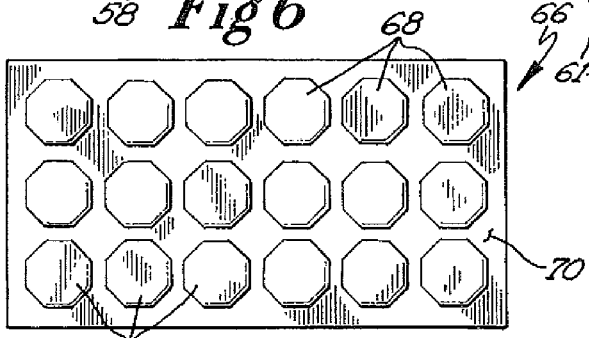

FIGS. 6, 7, and 8 are top plan views of further alternative embodiment radiant heating and cooling panels;

FIGS. 9 and 10 are sectional views showing an interlocking arrangement of two adjacent radiant heating and cooling panels;

FIG. 11 is a schematic view of a radiant heating and cooling system employing multiple panels and flexible fluid-conducting tubing as a thermal control component; and FIG. 12 is a schematic view of a radiant heating system employing an electrical heating element as a thermal control component.

DETAILED DESCRIPTION OF THE PREFERRED EMBODIMENTS

Figure 1:
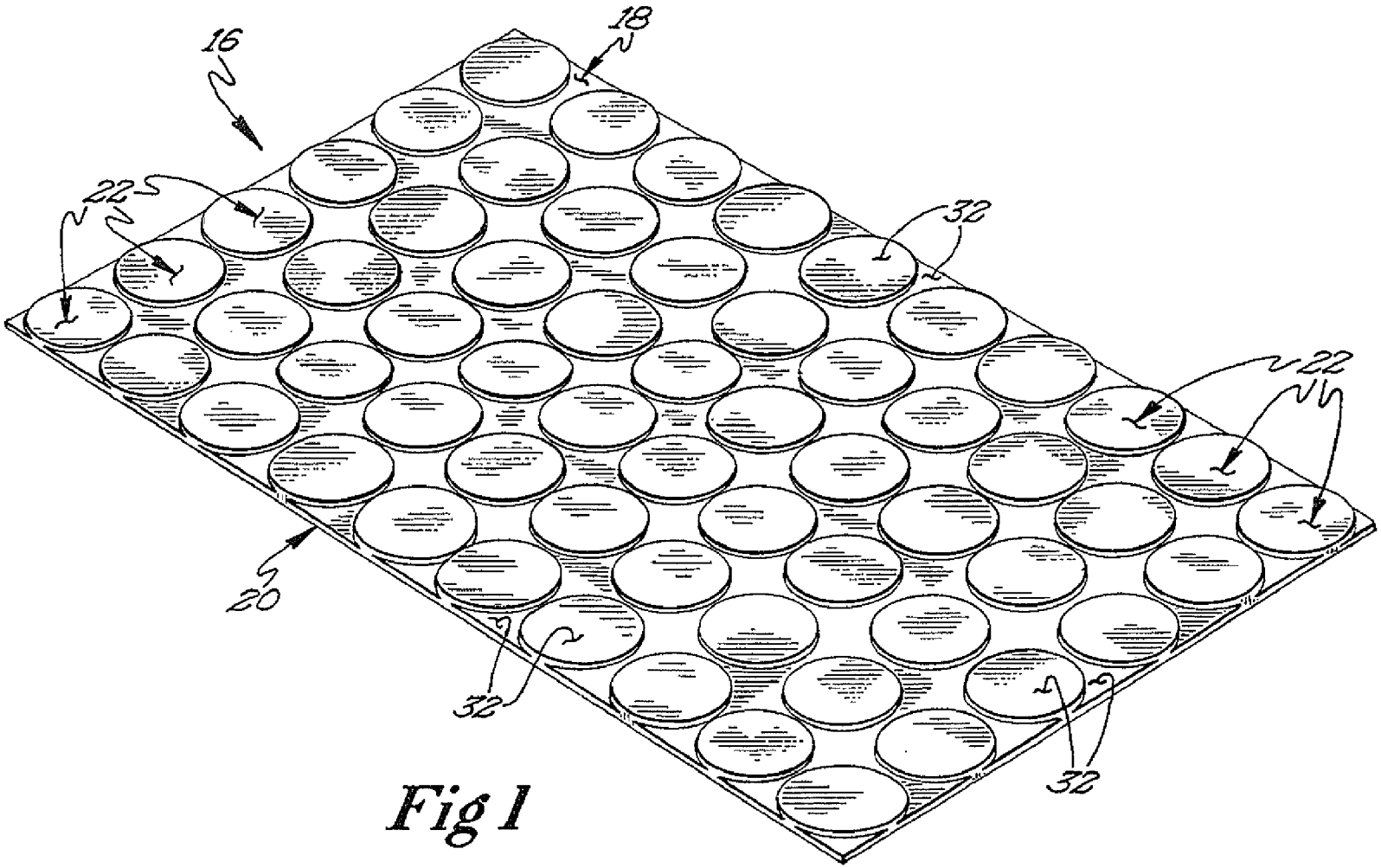
FIG. 1 is a perspective view of a radiant heating and cooling panel constructed in accordance with the present invention.

Turning now to the drawings, there is shown in FIG. 1 a radiant heating and cooling panel 16 constructed in accordance with the present invention. Panel 16 and multiple additional substantially identical panels cooperate to provide a guide layer for installing hydronic heating or cooling tubing, or alternatively an elongate electrical heating element, in a desired pattern in a radiant heating or cooling system. The panel includes a unitary shell 18 preferably formed of a moisture impermeable plastic such as polyester, polystyrene, or polyurethane. The shell includes a substantially flat and rectangular or square base 20, and a plurality of disk-shaped projections 22 extended outwardly from the base, more particularly upwardly when panel 16 is used in a floor mounted radiant temperature control system.

Figure 2:
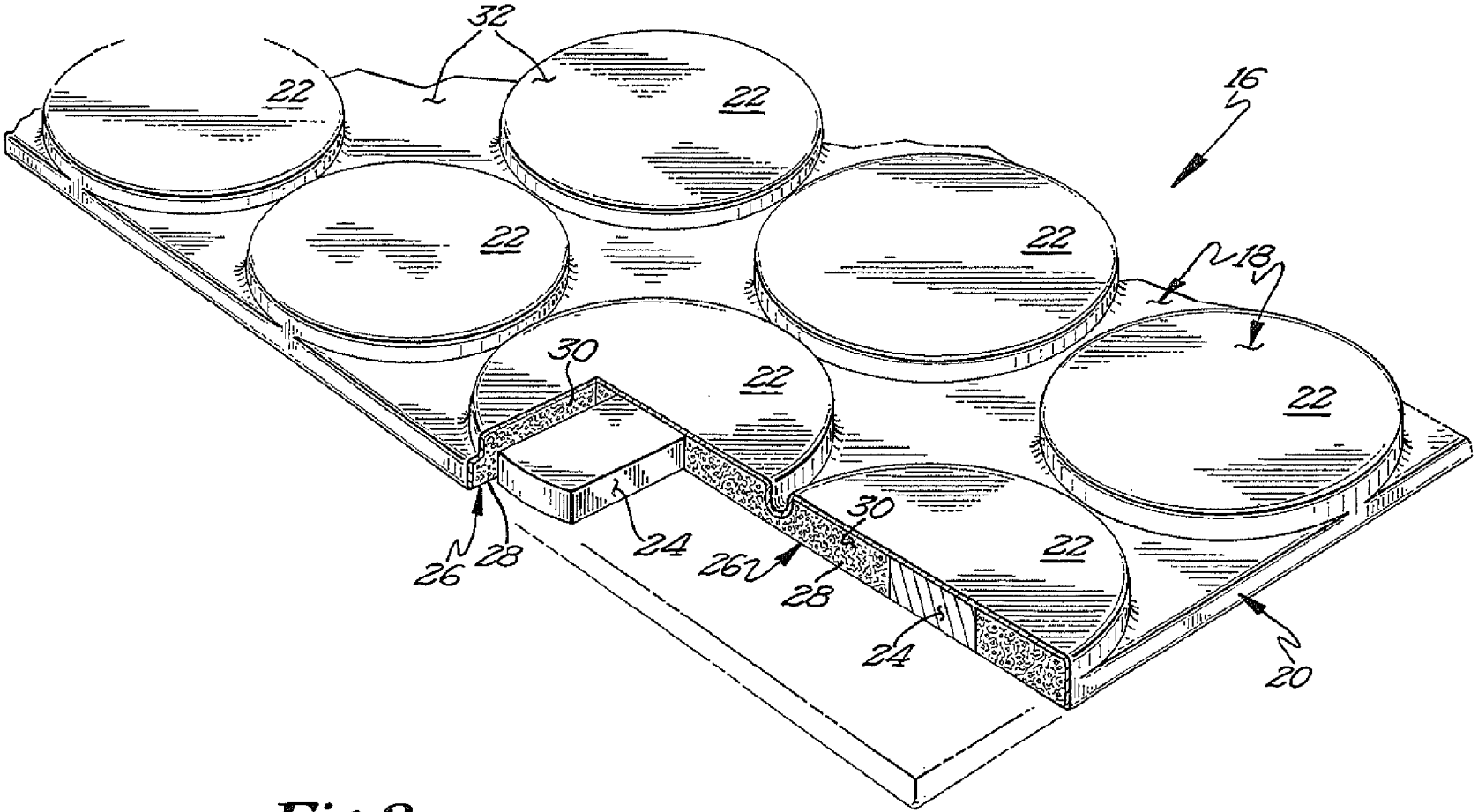
FIG. 2 is an enlarged partial perspective cutaway view of the panel.

As seen in FIG. 2, panel 16 is a composite of several components in addition to the shell. A portion of the panel is cut away to reveal that projections 22 have cylindrical internal chambers that contain additional components. One of these is an elongate anchor 24, which also serves as a pedestal or structural support member. The lengthwise extension of anchor 24 is nearly equal to the chamber diameter, while the width of the anchor is about half the chamber diameter. The weight bearing capacity of anchor 24 is particularly important when panel 16 is part of a flooring layer, because it permits the use of panels 16 without an over-pour of concrete or any auxiliary weight bearing components. In addition, anchors 24 can receive nails, screws, or other fasteners for securing overlying flooring layers such as hardwood flooring, or plywood to support tiles or carpeting. In alternative versions of the panel, anchors 24 are disk shaped and fully occupy the chambers.

Because of anchors 24, panel 16 can be used in systems that do not include a concrete over-pour. As compared to panel designs in which the anchors (e.g. in the form of furring strips) extend lengthwise across the entire length or width of the panel, panel 16 weighs considerably less and is more flexible in terms of the permitted patterns and arrangements of the hydronic tubing or other temperature control element.

An insulative layer 26 is partially contained within projections 22. More particularly, a lower region 28 of the insulative layer extends over the complete length and width of base 20, while upper regions 30 of the insulative layer are contained within the projection chambers. Insulative layer 26 can be formed of fiberglass, or an expanded foam such as polystyrene foam.

An upper surface of panel 16, including the base top surface, top surfaces of the projections, and side walls of the projections, is covered with a continuous, thermally conductive layer 32, preferably metallic. Conductive layer 32 can be applied by spraying or plating, or can be attached as a metal foil, e.g. of aluminum. Suitable alternative metals include gold, steel, and copper. Another alternative is a biaxially-oriented polyethylene terephthalate (boPET) thin film. The metalized film, available under the brand name Mylar, has a high tensile strength and is highly reflective of infrared energy.

In one suitable approach, a three foot by five foot panel 16 can incorporate sixty projections 22 in six rows of ten projections each. The diameter of each projection is slightly less than six inches, to provide a spacing between adjacent projections suitable for a nesting engagement or snug fit of a hydronic tube in the channel between the projections. The interprojection spacing would be commensurate with the selected tubing size, typically ranging from 5/16 inch to 3/8 inch and commonly 3/8 inch inside diameter.

Figure 3:
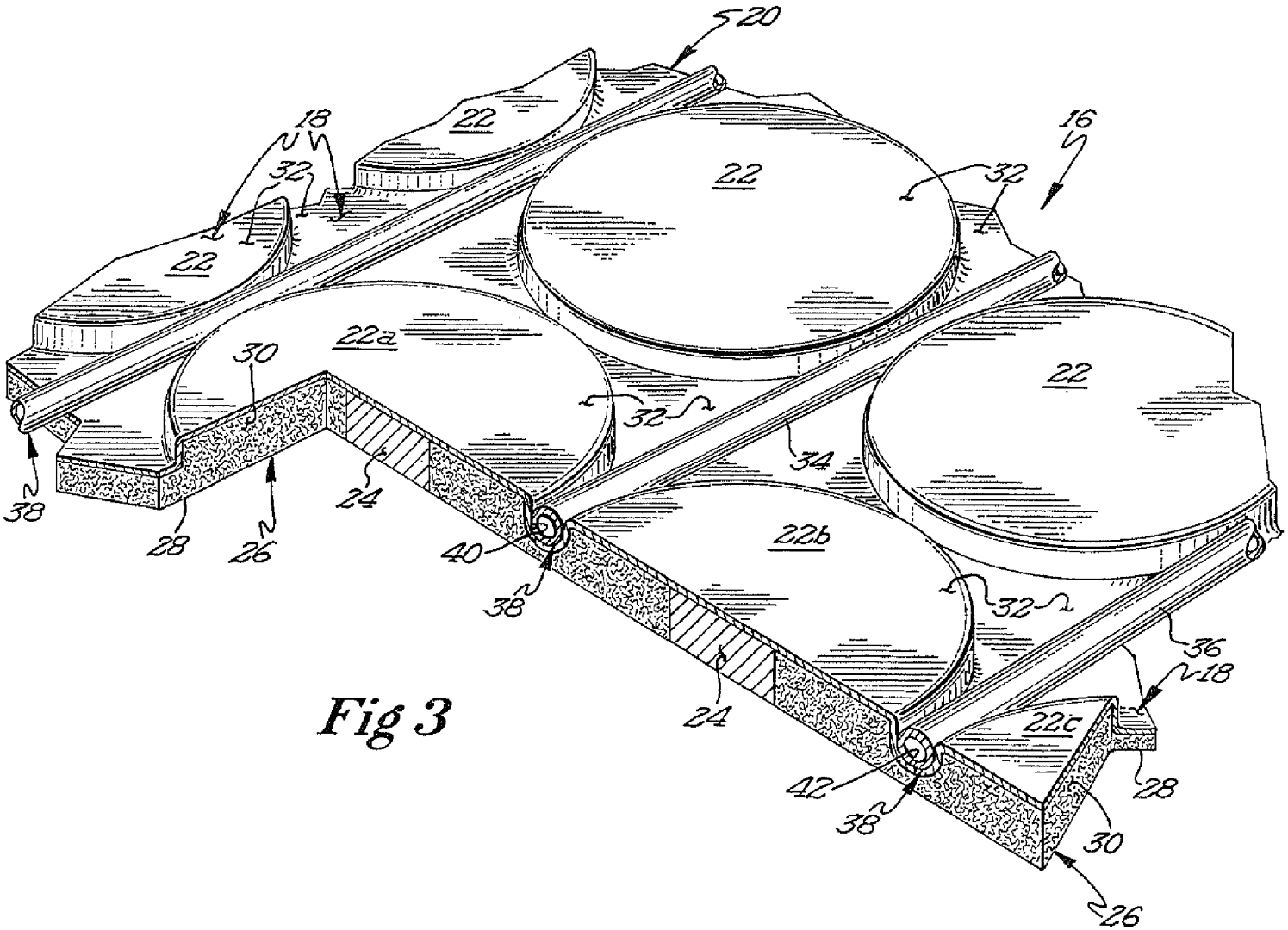
FIG. 3 is a further enlarged perspective view showing sections of radiant heating and cooling tubing mounted onto the panel.

A flooring layer composed of multiple panels 16 provides a guide structure for laying an elongate flexible thermal control component, e.g. tubing for radiant heating or cooling or an elongate flexible electrical heating element. FIG. 3 illustrates two tubing sections 34 and 36 of a continuous length 38 of PEX (cross linked polyethylene) tubing for a radiant heating or cooling system. Tubing section 34 is contained within a channel 40 between projections 22*a* and 22*b*. Tubing section 36 is contained within a channel 42 between panels 22*b* and 22*c*. Sections 34 and 36 represent parallel, side-by-side lengths of the tubing. Projections 22 set a minimum transverse spacing between adjacent tubing sections. Near the ends of sections 34 and 36, the tubing is formed into a bend around one of projections 22 to provide a semi-circular section (not shown in the figure) between sections 34 and 36. Projections 22 set the minimum radius of curvature for semi-circular and other arcuate sections.

Figure 4:
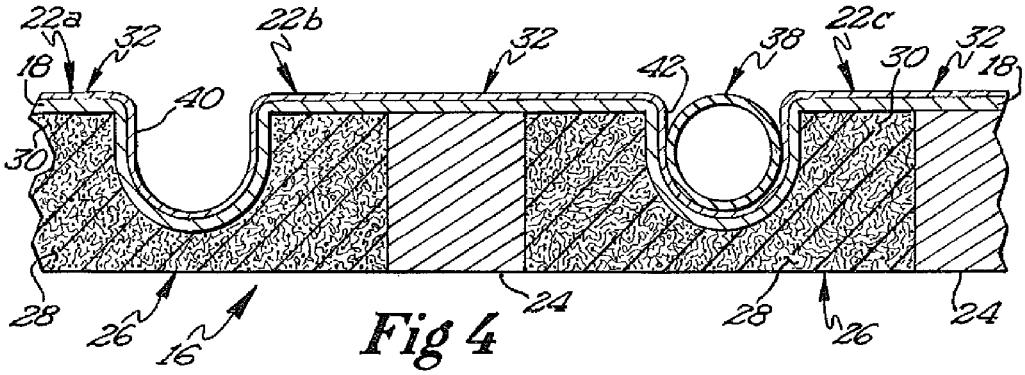
FIG. 4 is a sectional view through the panel showing one of the tubing sections.

Panels 16 are designed to increase the efficiency of radiant heating and cooling systems, by promoting heat transfer into the room, i.e. upwardly in the case of floor mounted panels, and by diminishing heat transfer into the floor or wall. As seen in FIG. 4, thermal conduction from tubing 38 into the room is promoted by conductive layer 32, which is in contact with the tubing along the channels between adjacent projections 22 and along the upper surface of base 20. Accordingly, in heating applications the heat is radiated not only from tubing 38, but also to a considerable extent from base 20 and projections 22. This leads to a more uniform application of heat to the flooring level above the panels, minimizing or eliminating undesirable inconsistencies in temperature, i.e. "hot spots" and "cold spots".

At the same time, insulative layer 26 minimizes any downward transfer of heat from tubing 38 or from conductive layer 32, thus reducing waste heat to increase efficiency. As seen in FIG. 4, the profile or height of the layer formed by panels 16 is small, dictated largely by the diameter of tubing 38 and to a lesser extent by a desired thickness of insulation beneath the tubing.

Figure 5:
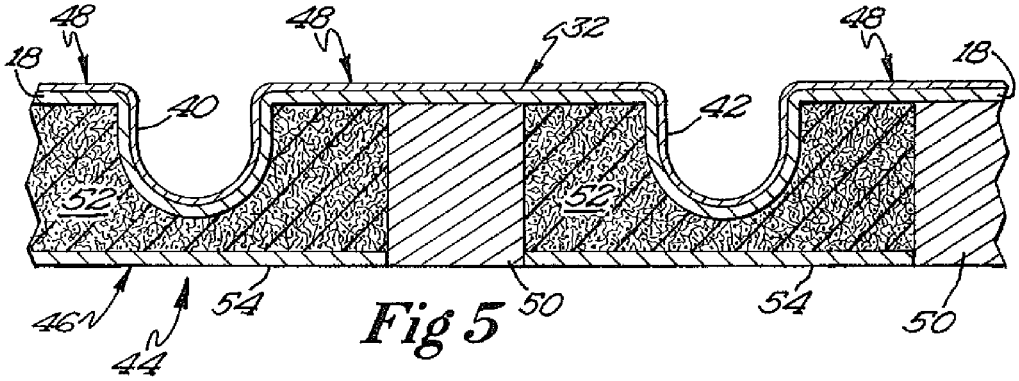
FIG. 5 is a sectional view similar to that in FIG. 4 showing an alternative embodiment panel.

FIG. 5 is a view similar to FIG. 4 showing an alternative embodiment panel 44 having a base 46 and plurality of projections 48 extending upwardly from the base. As before, the base and projections are formed of a substantially rigid polymeric material. The projections form cylindrical chambers, each housing an elongate anchor 50 and an insulative layer 52.

In a departure from the earlier embodiment, panel 44 incorporates a bottom wall 54 that substantially spans the length and width of the base. The bottom wall can be provided with rectangular openings to leave anchors 50 exposed as shown. Alternatively, the bottom wall can cover the anchors, in which case a tougher and more durable polymer may be required for wall 54, in that the wall when covering the anchors assumes the weight bearing and shock absorbing functions of the anchors.

FIG. 6 is a top view of an alternative embodiment panel 56 in which multiple projections 58 are staggered, rather than arranged in straight columns and rows.

FIG. 7 is a top view of another alternative embodiment panel 60 in which a plurality of projections 62 extended upwardly from a base 64. The projections have elongate profiles with side walls 61 and semicircular end walls 63, with a longitudinal length of about twice the transverse width. An advantage of this approach is that channels between adjacent projections 62 are longer, increasing the area of substantially surrounding surface contact of the thermally conductive layer with the tubing. In one particularly preferred arrangement, adjacent projections are spaced apart lengthwise by eight inches center-to-center, and spaced transversely at six inches center-to-center. This facilitates mounting the panels to floors and walls of a standard building construction of sixteen inches on center in one direction and twelve inches on center in the other, perpendicular direction. This approach favors installing lengthwise extensions of the tubing in the longitudinal direction, and accordingly is somewhat less flexible in terms of how the tubing can be arranged.

FIG. 8 is a top view of a further alternative panel 66 in which each of a plurality of projections 68 extending upwardly from a base 70 has an octagonal profile. As compared to the disk shaped projections of panel 16, projections 68 are advantageous from the standpoint of providing longer channels between adjacent projections in which the tubing can be substantially surrounded by the thermally conductive channel wall. At the same time, the flexibility of tubing arrangements is comparable to that of panel 16, because the projections are not elongated.

The panels advantageously can be equipped with interlock features to couple adjacent panels when multiple panels are employed in a radiant heating and cooling system. FIG. 9 is a partial view of two adjacent panels. While only moisture impermeable shells 72 and 74 are shown, it is to be understood that the panels incorporate anchoring members, insulative layers and conductive layers as previously discussed. In terms of the shape and arrangement of projections, shells 72 and 74 can be configured according to any of the versions previously discussed.

Shell 72 includes a base 76 and multiple projections, one of which is shown at 78 with a peripheral wall 80 and an outer or top wall 82. The shell further is shaped to provide a tube retaining feature 84. Similarly, shell 74 includes a base 86, a projection 87 with a peripheral wall 88, a top wall 90 and a tube retaining feature 92.

Shell 72 includes an interlock feature in the form of a tongue 94 extending downwardly from base 76. The tongue preferably extends along the entire length of the panel side edge. Shell 74 has a complementary interlock feature in the form of a U-shaped member 96 forming a groove 98. Member 96 preferably extends along the entire side edge of shell 74.

Tongue 94 and groove 98 have substantially the same width, such that the tongue is insertable into the groove for a friction fit as illustrated in FIG. 10. This integrally couples shells 72 and 74, and determines a spacing between projections 78 and 87 commensurate with the spacing between adjacent projections of the same shell. As a result, when multiple panels are coupled together the resulting pattern of projections is consistent with the pattern on any one of the panels.

All four edges of a given panel can be equipped with interlock features 94 and 96. A preferred arrangement includes a tongue 94 along a top edge and one of the side edges and a member 96 along the bottom edge and the other side edge.

FIG. 11 is a schematic view showing several panels 100 assembled into a radiant heating and cooling system. An elongate flexible thermal control component, specifically a length of tubing 102, is coupled to a fluid source 104 to receive a liquid for transmission along tubing 102 in the direction indicated by the arrows. The tubing conducts the liquid in a somewhat serpentine path along the panels before the liquid is returned to a fluid sink 106. Typically the system is recirculating or closed, with a pump 108 moving the liquid from sink 106 to source 104 through a control module 110. The module either adds heat to the fluid or extracts heat from the fluid, depending on whether the system is being used for heating or cooling.

FIG. 12 illustrates a radiant heating system 112 in which the elongate flexible temperature control component is an electrical heating element 114. Heating element 114 is coupled to a high voltage terminal 116 of an electrical power source, proceeds in a serpentine path along an assembly of panels 118 to a coupling with a low voltage terminal 120 of the power source.

To install a system, e.g. on a concrete floor, panels 16 (or panels of the other embodiments) are laid into place, secured to the substrate or subfloor with an adhesive. This can be accomplished by applying a pressure sensitive adhesive to the bottom (especially the bottom surfaces of anchors 24) of panels similar to panel 16, or to the bottom surfaces of anchors 50 and bottom wall 54 in panels like panel 44. Alternatively the adhesive can be applied to the substrate. Panels are trimmed as necessary to complete a span between opposite walls, and account for corners and irregularities. There is no need to assemble thermally conductive components, insulative components, anchoring components, load bearing components or a vapor barrier into the panel, since these components are incorporated into the panel structure. Accordingly, the system can be installed with relative ease, without highly skilled labor. The panels may incorporate interlocking features along their side and end edges as discussed above to ensure an interlocking engagement of the panels to form a single continuous floor layer.

After the panels have been installed, the flexible tubing (or alternatively the elongate electrical heating element) is installed between pairs of adjacent projections to form a desired pattern or arrangement. If the user discovers an error or decides to form a different pattern, the tubing or heating element is simply removed and repositioned.

At this stage, a concrete over-pour can be effected if such is part of the planned system. Alternatively, the panels are well suited for systems that do not contemplate a concrete over-pour, because the built in anchors provide structural support (weight bearing) and anchoring for a subsequent layer of flooring.

The subsequent flooring layer typically involves a cover layer such as plywood or particle board to serve as a sub-floor for a finished layer, e.g. carpeting or tile. Alternatively, a hardwood floor might be applied directly to the layer formed by the panels. In either event, the fasteners (e.g. nails or screws) used to secure the floor are installed through the cover layer directly into the anchors. The anchors are uniquely well suited for using nails, staples and other driven fasteners to retain the cover layer. This is due in part to their construction of wood, composites of wood and plastic or other materials capable of applying the lateral compressive forces necessary to frictionally retain axially driven fasteners.

The ability to use staples or nails considerably reduces the time required for installing the flooring layer overlying the panels. The anchors do not need any preformed holes or other guides to receive fasteners for retention. Thus, a given fastener about to be advanced through a cover layer need not be precisely aligned with a hole or other guide feature of the anchor, but only with the anchor itself. This is advantageous with respect to nondriven fasteners as well. A pilot hole for a screw can be drilled through the cover layer and into the anchor, without any need to align the pilot hole with a previously formed hole in the anchor.

Regardless of the particular version, the panels are sufficiently versatile for use in a variety of systems, in new or existing construction, over wood or concrete floors, for heating or cooling, for either hydronic or electric temperature control, and without regard to whether concrete over-pour is contemplated. Systems can be installed on walls and ceilings as well as floors.

The panels consist largely of lightweight materials, i.e. a polymeric shell, relatively small anchors of wood or a composite of wood and plastic, the insulation, and the conductive film or foil. As a result the panels are easy to ship, handle, and install. The panels have a low profile (i.e. height in floor installed panels), to minimize any intrusion into the interior space. Finally, an advantageous positioning of layers, one thermally insulative and the other thermally conductive, more efficiently uses heating or cooling energy and provides for a more uniform temperature distribution.

What is claimed is:

1. A temperature control flooring system, including:

a moisture impermeable layer comprising a base and a plurality of projections extended upwardly from the base, each of the projections comprising a substantially planar top wall and a peripheral wall between the top wall and the base wherein the top wall and peripheral wall cooperate to define an internal chamber open at a bottom thereof;

wherein adjacent ones of the projections are spaced apart from one another to define channels therebetween to receive a flexible elongate thermal control component, the projections being disposed in an array selected to enable and facilitate placement of the flexible elongate thermal control component in a path along the base and disposed between different pairs of the projections; and an anchoring layer comprising a plurality of anchoring members individually associated with the projections, each anchoring member occupying its associated chamber, attached to the associated top wall and extending downwardly to a location below the base, the anchoring layer further comprising a lower surface adapted for attachment to a substrate to integrally mount the moisture impermeable layer with respect to the substrate and structurally support the moisture impermeable layer when so mounted;

wherein each of the anchoring members is capable of exerting lateral forces to frictionally secure axially driven fasteners against axial withdrawal, thereby to facilitate use of said fasteners to mount a flooring layer in overlying relation to the moisture impermeable layer by advancing the fasteners through the flooring layer and moisture impermeable layer into the anchoring members.

2. The system of claim 1 further including:

a thermally conductive layer in overlying contact with an upper surface of the moisture impermeable layer including surfaces of the channels and the top walls.

3. The system of claim 1 further including:

a thermally insulative layer disposed between the moisture impermeable layer and the lower surface of the anchoring layer.

4. The system of claim 1 wherein:

each of the anchoring members has a substantially planar bottom surface, with the bottom surfaces occupying substantially the same plane and cooperating to provide said lower surface of the anchoring layer.

5. The system of claim 1 wherein:

the anchoring layer further comprises a weight bearing layer integral with the anchoring members and disposed adjacent the bottom surfaces of the anchoring members.

6. The system of claim 1 wherein:

the projections are arranged in substantially straight rows and columns.

7. The system of claim 1 wherein:

the height of each of the projections is substantially equal to a diameter of a selected tubular thermal control component.

8. The system of claim 3 wherein:

the thermally insulative layer compromises an insulative lower region disposed below the base of the moisture impermeable layer.

9. The system of claim 3 wherein:

the thermally insulative layer comprises insulative regions occupying the chambers.

10. The system of claim 6 wherein:

a profile of each projection taken in a horizontal plane through the projection, is selected from the group of profiles consisting of: circular profiles; elongate profiles with semi-circular ends; and polygonal profiles.

11. A radiant heating and cooling panel, including:

a structurally self supporting and moisture impermeable shell including a base and a plurality of projections each having a peripheral wall extending away from the base in an outward direction and a substantially planar outer wall joined to an outer end region of the peripheral wall, the outer wall cooperating with the peripheral wall to define an internal chamber of the projection open along an inward side of the shell;

wherein the projections are disposed in an arrangement to receive a flexible elongate thermal control component in a path and situated between different pairs of the projections, and the projections of each pair are spaced apart from one another by a predetermined distance to accommodate placement of the thermal control component between them;

a plurality of anchoring members individually associated with the projections, wherein each anchoring member occupies the chamber of its associated projection, is attached to the associated outer wall and extends inwardly to locate an inner end region thereof inwardly of the base; and an anchoring component adapted to an integrally attach the anchoring members to a substrate having substantially planar substrate surfaces to secure the moisture impermeable shell integrally with respect to the substrate;

wherein the outer walls of the projections extend substantially along an outer plane parallel to the plane of the substrate surface when the anchoring members are so attached;

wherein each of the anchoring members at least along an outer region thereof is capable of exerting lateral forces to frictionally secure axially driven fasteners against axial withdrawal, thereby to facilitate use of said fasteners to mount an outer layer in overlying relation to the moisture impermeable shell by advancing the fasteners through the outer layer and shell into the anchoring members.

12. The panel of claim 11 wherein:

the anchoring component comprises an adhesive.

13. The panel of claim 11 wherein:

the projections are arranged in straight rows and columns.

14. The panel of claim 11 wherein:

the projections are arranged in staggered rows and columns.

15. The panel of claim 11 wherein:

each of the projections has a circular profile in planes parallel to the outer plane and extending through the peripheral wall.

16. The panel of claim 11 wherein:

each of the projections has an elongated profile with semi-circular end regions in planes parallel to the outer plane and extending through the peripheral wall.

17. The panel of claim 11 further including:

a thermally conductive layer overlying and contiguous with an outside surface of the shell.

18. The panel of claim 11 further including:

a thermally insulative layer overlying and contiguous with an inside surface of the shell and extending inwardly beyond the base.

19. The panel of claim 11 wherein:

the anchoring component comprises a substantially planar structural layer integrally coupled to the anchoring members adjacent the inner end regions thereof, and extending in a direction parallel to the outer plane.

20. The panel of claim 11 wherein:

adjacent ones of the projections are spaced apart from one another by a distance selected for frictional retention of the flexible elongate thermal control component.

21. A process for installing a thermal control system, including:

providing a panel including a moisture impermeable shell with a base and a plurality of projections extending away from the base in an outward direction to form internal chambers open at the base, and an anchoring layer comprising a plurality of anchoring members individually associated with the projections, each anchoring member occupying its associated chamber with an outer end of the anchoring member integrally attached to an outer wall of the associated projection and extending inwardly to an inner end region disposed inwardly of the base;

mounting the panel to a substrate having a substrate surface using an adhesive between the substrate surface and in inner end surface of the anchoring layer to integrally secure the anchoring layer to the substrate;

after mounting the panel, positioning a flexible elongate thermal control component against the base in a path and disposed between pairs of adjacent projections;

with the thermal control component so positioned, placing an outer layer against the outer walls of the projections to capture the thermal control component between the outer layer and the shell; and with the outer layer so placed, advancing a plurality of elongate fasteners axially through the outer layer and shell into the anchoring members to integrally secure the outer layer to the substrate via the panel.

22. The process of claim 21 wherein:

mounting the panel to the substrate comprises applying the adhesive to the inner end surfaces.

23. The process of claim 21 wherein:

positioning the thermal control component comprises retaining the component frictionally between the adjacent pairs of projections.

24. The process of claim 21 further including:

coupling opposite ends of the thermal control component to a fluid source and a fluid sink respectively, wherein the thermal control component comprises a flexible tube.

25. The process of claim 21 further including:

coupling opposite ends of the thermal control component to an electrical power supply at a high-voltage terminal and a low-voltage terminal respectively, wherein the thermal control component comprises an electrical heating element.

* * * * *